US007205865B2

(12) United States Patent
Kang et al.

(10) Patent No.: US 7,205,865 B2
(45) Date of Patent: Apr. 17, 2007

(54) POWER DIVIDER AND COMBINER IN COMMUNICATION SYSTEM

(75) Inventors: Hyun-II Kang, Ansan-si (KR); Kyung-Hun Jang, Suwon-si (KR); Hyo-Sun Hwang, Seoul (KR); Jun-Seok Park, Goyang-si (KR)

(73) Assignee: Samsung Electronics Co., Ltd. (KR)

( * ) Notice: Subject to any disclaimer, the term of this patent is extended or adjusted under 35 U.S.C. 154(b) by 39 days.

(21) Appl. No.: 11/080,006

(22) Filed: Mar. 14, 2005

(65) Prior Publication Data

US 2006/0028297 A1 Feb. 9, 2006

(30) Foreign Application Priority Data

Aug. 4, 2004 (KR) ..... 10-2004-0061395

(51) Int. Cl.
*H01P 5/12* (2006.01)

(52) U.S. Cl. ..... 333/128; 333/1; 333/24 R; 333/100

(58) Field of Classification Search ..... 333/128, 333/24 R–24.3, 1, 1.1
See application file for complete search history.

(56) References Cited

U.S. PATENT DOCUMENTS

| | | | | |
|---|---|---|---|---|
| 2,784,381 A | | 3/1957 | Budenbom | |
| 3,701,056 A | | 10/1972 | Ozawa et al. | |
| 3,963,990 A | * | 6/1976 | DiFonzo | 455/304 |
| 4,419,636 A | * | 12/1983 | Yu | 333/131 |
| 4,679,010 A | * | 7/1987 | Bahl | 333/109 |

(Continued)

FOREIGN PATENT DOCUMENTS

KR 10-2002-0062921 10/2002

OTHER PUBLICATIONS

D'Agostino et al., "Innovative Power Distributed Amplifier Using the Wilkinson Combiner", IEE Proceedings: Microwaves, Antennas and Propagation, vol. 142, No. 2, Apr. 1, 1995, pp. 97-101.

(Continued)

*Primary Examiner*—Robert Pascal
*Assistant Examiner*—Kimberly E Glenn
(74) *Attorney, Agent, or Firm*—The Farrell Law Firm

(57) ABSTRACT

Disclosed is a high frequency omni-directional 2-way power divider which includes one input terminal and two output terminals so that a signal inputted through the input terminal is uniformly distributed to the two output terminals. The high frequency omni-directional 2-way power divider includes: a first Wilkinson regular divider including one input terminal and first and second output terminals; a second Wilkinson regular divider including one input terminal and third and fourth output terminals, the third output terminal being connected to the first output terminal of the first Wilkinson regular divider; and a third Wilkinson regular divider including one input terminal and fifth and sixth output terminals, the fifth output terminal being connected to the second output terminal of the second Wilkinson regular divider and the sixth output terminal being connected to the fourth output terminal of the second Wilkinson regular divider, wherein, when one of the three input terminals contained in the first to the third Wilkinson regular divider is used as the input terminal of the 2-way power divider, other two input terminals are used as output terminals, to which power is uniformly distributed.

16 Claims, 8 Drawing Sheets

U.S. PATENT DOCUMENTS

| | | | | |
|---|---|---|---|---|
| 4,875,024 | A * | 10/1989 | Roberts | 333/127 |
| 5,247,269 | A * | 9/1993 | Boulouard et al. | 333/126 |
| 5,455,546 | A | 10/1995 | Frederick et al. | |
| 2002/0158706 | A1 | 10/2002 | Edwards et al. | |

OTHER PUBLICATIONS

T.M. Weller et al., "Membrane Technology (MIST-T) Applied To Microstrip: A 33 GHz Wilkinson Power Divider", Microwave Symposium Digest, May 23, 1994.

* cited by examiner

POWER DIVIDER AND COMBINER IN COMMUNICATION SYSTEM

PRIORITY

This application claims priority to an application entitled "Power Divider And Combiner In Communication System" filed in the Korean Intellectual Property Office on Aug. 4, 2004 and assigned Serial No. 2004-61935, the contents of which are incorporated herein by reference.

BACKGROUND OF THE INVENTION

1. Field of the Invention

The present invention relates to a divider and a combiner in a communication system, and more particularly to a power divider and a combiner in a Wireless Local Area Network ('WLAN') system.

2. Description of the Related Art

Generally, a WLAN is a data communication system that is substituted for a conventional wired LAN and allows for exchange of data by means of a radio frequency ('RF') signals, even without a wired network. That is, WLANs provide all advantages and functions of the conventional LAN technology, such as an Ethernet or a token ring, without being restrained by a wired network.

A WLAN includes a plurality of access points ('APs') connected to a network by a wire and a plurality of stations connected to the AP wirelessly. The WLAN and the stations use the RF signal as a transmission medium. Accordingly, when a station frequently moves or a wire installation is difficult, the WLAN may be usefully utilized.

The WLAN employs a Carrier Sense Multiple Access/Collisions Avoidance ('CSMA/CA') scheme as a protocol of a Media Access Control (MAC) layer. The CSMA/CA scheme is obtained by modifying a Carrier Sense Multiple Access/Collisions Detection ('CSMA/CD') scheme used in a wired LAN in accordance with the characteristics of the WLAN. In the CSMA/CD scheme, any station may transmit data regardless of sequence, data collision on a channel is detected, and data are retransmitted when data collision occurs. In contrast, in the CSMA/CA scheme, a station confirms whether or not a channel through which data are to be transmitted is being used, and the station transmits data when the channel is in an idle state. However, when the channel is being used, the station confirms availability of the channel at a preset time and then transmits data. Since the CSMA/CA scheme has no additional control message and a simple operation process as compared with the CSMA/CD scheme, the CSMA/CA scheme may be easily achieved. Therefore, the CSMA/CA scheme is being used in a WLAN system.

In consideration of the characteristics of an RF signal, the RF signal used in such a WLAN cannot penetrate a wall in a building having a steel frame structure. Further, a shift phenomenon may occur in which the frequency band of the RF signal changes due to the presence of a wall.

FIG. 1 is a view showing a general example in which a conventional WLAN AP is installed inside a steel frame building.

Referring to FIG. 1, the inside of the building is partitioned by walls 113, 115. Herein, the AP 101 and some of stations 107, 109 and 111 do not communicate with each other via an RF signal due to the presence of walls 113, 115, respectively. Therefore, since service is not provided to some of stations 107, 109 and 111, but is provided to stations 103, 105, 107, 109 and 111, a service shadow area can be said to occur.

A method for solving the aforementioned problem includes using an RF cable, a divider and a horn antenna.

FIG. 2 is a view showing a wall-embedded type antenna system for indoor wireless communication. Referring to FIG. 2, the apparatus includes a plurality of antennas 201, 203 and 205, a divider 207 connected to the antennas 201, 203 and 205 via RF cables 211, 213 and 215, and an AP 209 connected to the divider 207 via an RF cable. In the apparatus, since the antennas 201, 203 and 205 are connected to the AP 209 by wire, interference between adjacent channels does not occur. A description on the above method has been in detail written in Korean patent application 10-2002-0062921. The system described in this application also must use the aforementioned CSMA/CA scheme. In order for the prior application to use the CSMA/CA scheme, when a station belonging to the service coverage of the first antenna 201 transmits data, stations belonging to the service coverages of the second and the third antenna 203 and 205 must have knowledge of the state of each channel. However, for instance, when a multi-direction divider is not used and the station belonging to the service coverage of the first antenna 201 transmits data to the AP 209, the stations belonging to the service coverages of the second and the third antenna 203 and 205 recognize that a channel is in an idle state and can simultaneously transmit data. Herein, since signals inputted to the second antenna 203 and the third antenna 205 are simultaneously transmitted to the AP 209 through the RF cables, data disruption can occur. Such an anomaly is called a hidden node problem. However, since it has been considered that the divider 207 only distributes power from the AP 209 to the antennas 201, 203 and 205, the divider 207 cannot be applied to the CSMA/CA scheme.

In order to solve the above-described problem, a divider is very important. A divider generally used includes a T junction divider, a resistive power divider and a Wilkinson power divider.

FIG. 3 is a view showing a conventional T junction divider. The T junction divider is a simple divider manufactured by dividing a line. Since the T junction divider can distribute power in omni-directions through ports 301, 303 and 305, the T junction divider can be applied to the system using the CSMA/CA scheme. However, since resistors are not used in lines 307, 309 and 311, the T junction divider has no loss of input power. However, since impedance matching in all ports is impossible, loss due to power reflection occurs.

FIG. 4 is a circuit diagram showing a resistive power divider. The resistive power divider is manufactured by coupling resistive elements 407, 409 and 411 to ports 401, 403 and 405, respectively. In the resistive power divider, the loss of input power occurs due to the resistive elements 407, 409 and 411. However, a desired power distribution ratio can be obtained and matching can be accomplished in all ports. Further, the resistive power divider can distribute power in omni-directions just as the T junction divider. However, since it is difficult to obtain the values of the resistive elements in an RF band or a micro frequency band and each resistive element is connected in serial to each port, a greater amount of power load is required. FIG. 5 is a circuit diagram showing a conventional Wilkinson power divider. The Wilkinson power divider is a power divider mainly used in an RF band or a micro frequency band. The Wilkinson power divider includes an input port 501, outputs ports 503 and 505, quarter wave microstrip lines 507 and 509 for port matching, and a balance resistor 511. The Wilkinson power divider uses the balance resistor 511 for port matching in an odd mode. Further, the Wilkinson power divider includes the balance resistor 511 for port matching in the odd mode connected in parallel to a power distribution port, the Wilkinson power divider has a high frequency characteristic and a power characteristic superior to those of the resistive power divider. However, in such a Wilkinson power divider, isolation is formed between the power distribution outputs ports 503 and 505 due to the balance resistor 511 used for port matching in the odd mode. Therefore, the Wilkinson power divider has an asymmetric characteristic. Consequently, since power is distributed in only one direction, it is difficult for the Wilkinson power divider to employ the CSMA/CA scheme.

SUMMARY OF THE INVENTION

Accordingly, the present invention has been made to solve the above-mentioned problems occurring in conventional systems, and it is an object of the present invention to provide a power divider capable of uniformly and omni-directionally distributing input power while minimizing the loss of the input power.

It is another object of the present invention to provide a power divider capable of enabling signal transmission between any ports while maintaining impedance matching in all ports.

In order to accomplish the aforementioned objects, according to one aspect of the present, there is provided a high frequency omni-directional 2-way power divider which includes one input terminal and two output terminals so that a signal inputted through the input terminal is uniformly distributed to the two output terminals, with the high frequency omni-directional 2-way power divider including: a first Wilkinson regular divider including one input terminal and a first and a second output terminal; a second Wilkinson regular divider including one input terminal and a third and a fourth output terminal, the third output terminals being connected to the first output terminal of the first Wilkinson regular divider; and a third Wilkinson regular divider including one input terminal and a fifth and a sixth output terminal, the fifth output terminal being connected to the second output terminal of the second Wilkinson regular divider and the sixth output terminal being connected to the fourth output terminal of the second Wilkinson regular divider.

According to the present invention, when one of the three input terminals contained in the first to the third Wilkinson regular dividers is used as the input terminal of the 2-way power divider, other two input terminals are used as output terminals to which power is uniformly distributed.

According to the present invention, each of the quarter wave microstrip lines has a characteristic impedance of 70.7Ω and a balance resistor has a value of 100Ω.

According to the present invention, each of the input terminals has a characteristic impedance of 50Ω.

In order to accomplish the aforementioned objects, according to one aspect of the present invention, there is provided a high frequency omni-directional 3-way power divider which includes one input terminal and three output terminals so that a signal inputted through the input terminal is uniformly distributed to the three output terminals, the high frequency omni-directional 3-way power divider including a first and a second high frequency 2-way divider, each of the first and the second high frequency 2-way dividers includes a Wilkinson regular divider having one input terminal and first and second output terminals; a first Wilkinson irregular divider having one input terminal and a first and a second output terminal, the first output terminal of the first Wilkinson irregular divider being connected to the first output terminal of the Wilkinson regular divider; a second Wilkinson irregular divider having one input terminal and first and second output terminals, the first output terminal of the second Wilkinson irregular divider being connected to the second output terminal of the Wilkinson regular divider, the second output terminal of the second Wilkinson irregular divider being connected to the second output terminal of the first Wilkinson irregular divider; a first quarter wave microstrip line connected to a point at which the first terminal of the Wilkinson regular divider is connected to the first output terminal of the first Wilkinson irregular divider; and a second quarter wave microstrip line connected to a point at which the second terminal of the Wilkinson regular divider is connected to the first output terminal of the second Wilkinson irregular divider, wherein, input terminals of the Wilkinson regular dividers of the first and the second high frequency 2-way divider are connected with each other, and wherein, when one of the input terminals contained in the first and the second high frequency 2-way divider is used as the input terminal of the high frequency omni-directional 3-way power divider, other three input terminals are used as output terminals to which power is uniformly distributed.

According to the present invention, the high frequency omni-directional 3-way power divider distributes power by −9 dB from one input terminal to remaining input terminals.

According to the present invention, power of −4.5 dB is distributed to each of the input terminals of the Wilkinson irregular dividers at a point at which input terminals of the Wilkinson regular dividers in the first and the second high frequency 2-way divider are connected with each other.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. A divider proposed through the present invention which will be described later not only uniformly distributes a signal through any port but also minimizes power loss. The apparatus proposed in the present invention will be called an omni-directional n-way power divider/combiner.

In a detailed description provided below, two representative embodiments of the present invention are described that achieve the aforementioned technical subject. First, an omni-directional 2-way power divider of the present invention is described. Next, an omni-directional 3-way power divider is briefly described. It will be apparent to those of skill in the art that the power divider can be extended to an n-way power divider. Further, since a divider becomes a combiner by differently applying an input/output, a divider-centered description is given in the present invention.

Figure 1:
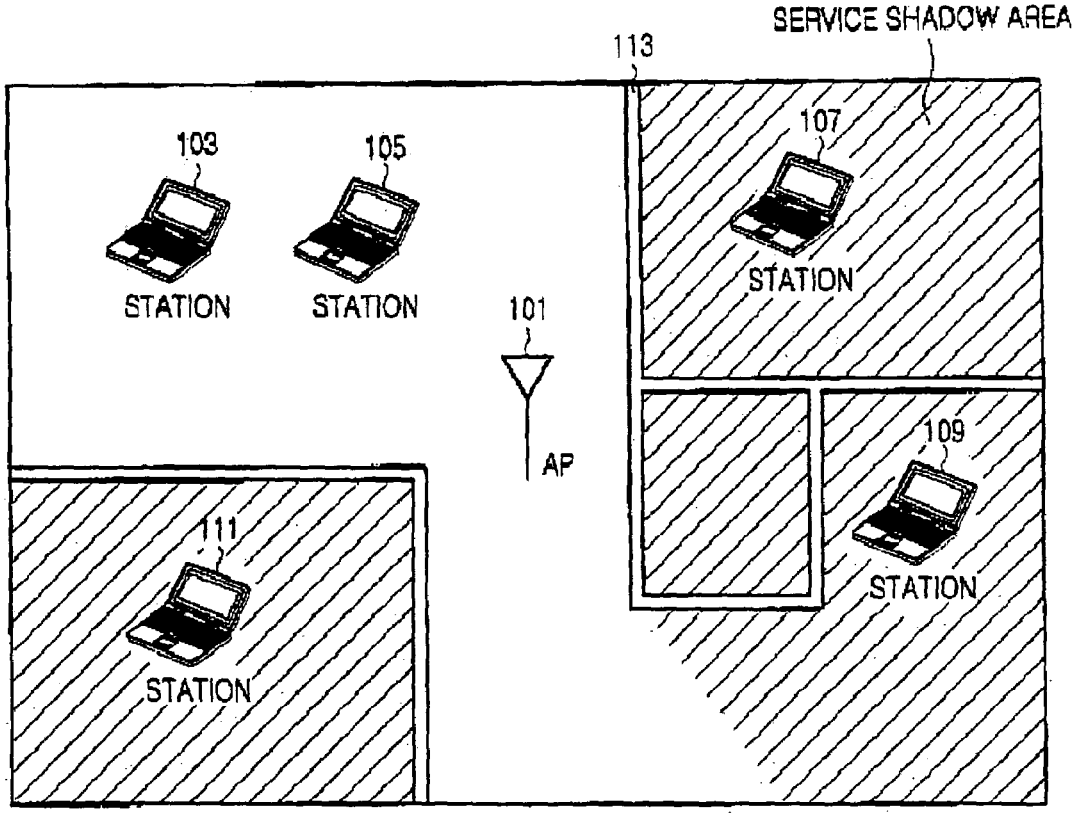
FIG.1 (PRIOR ART)
FIG. 1 is a view showing a general example in which a conventional WLAN AP is installed inside a steel frame building.
Figure 2:
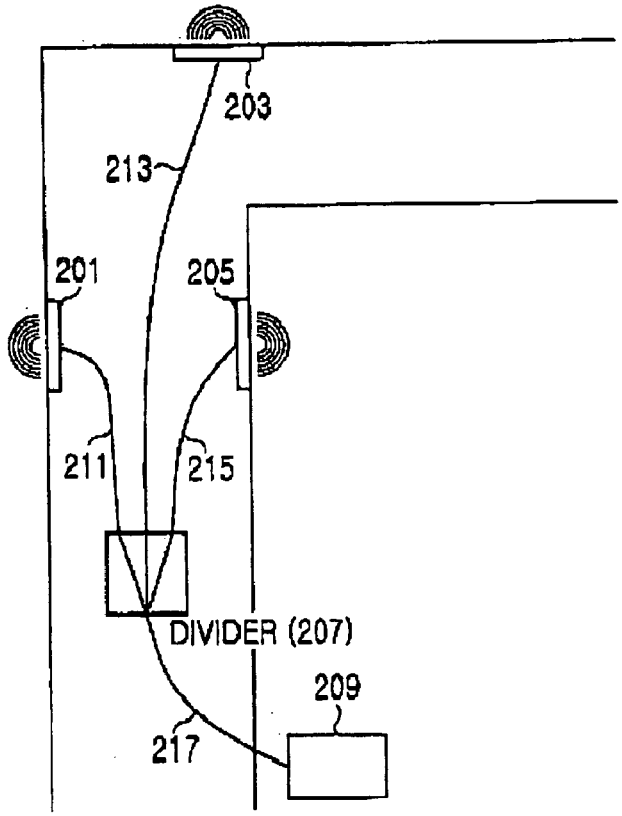
FIG. 2 is a view showing a wall-embedded type antenna system for indoor wireless communication.
Figure 3:
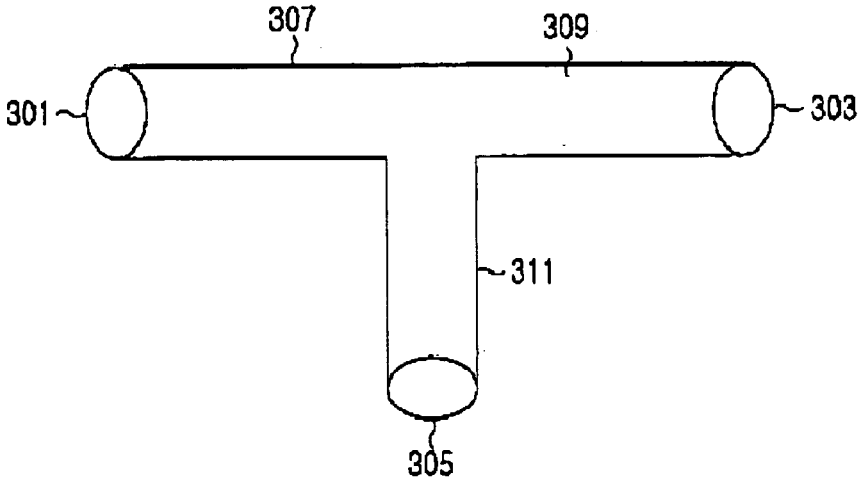
FIG. 3 is a view showing a T junction divider.
Figure 4:
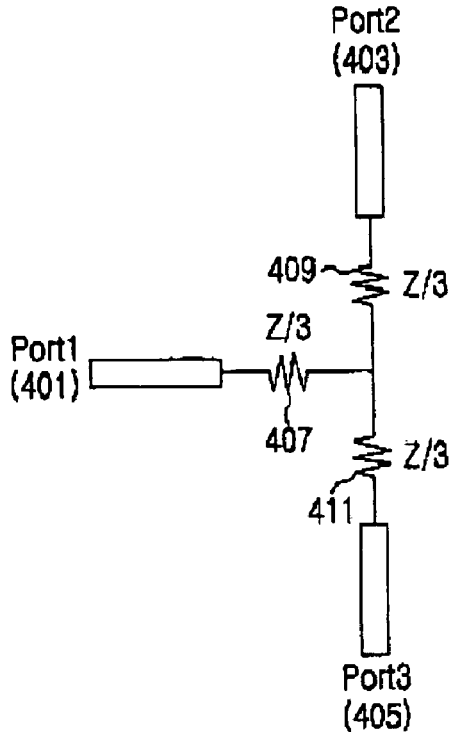
FIG.4 (PRIOR ART)
FIG. 4 is a circuit diagram showing a conventional resistive power divider.
Figure 5:
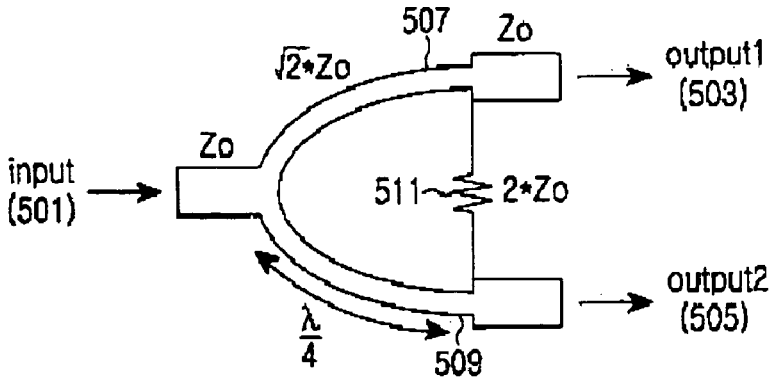
FIG. 5 is a circuit diagram showing a conventional Wilkinson power divider.
Figure 6:
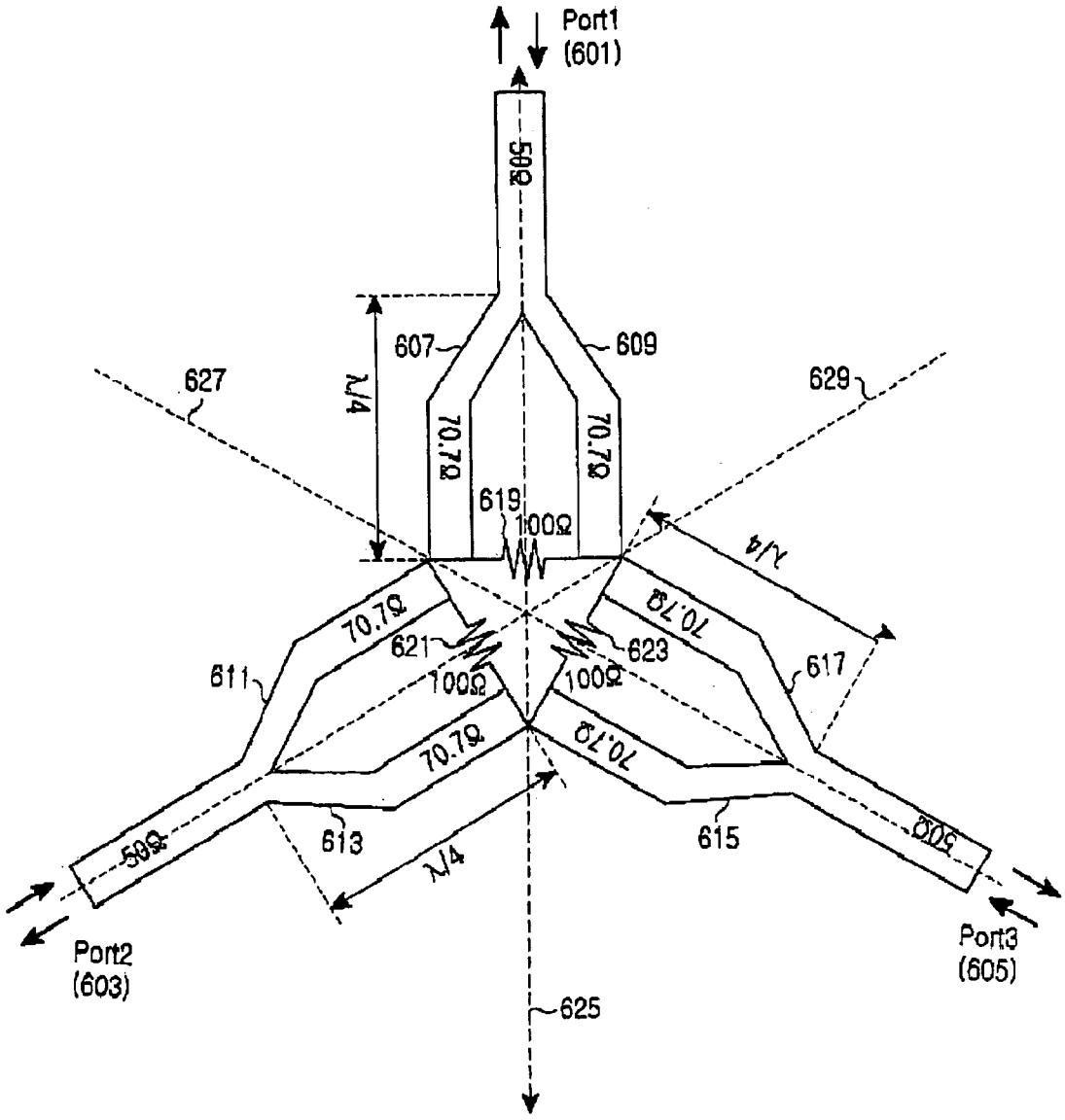
FIG. 6 is a view showing an omni-directional 2-way power divider according to a first preferred embodiment of the present invention.

FIG. 6 is a view showing an omni-directional 2-way power divider according to a first preferred embodiment of the present invention. Referring to FIG. 6, the omni-directional 2-way power divider includes three input/output ports, that is, a first port 601, a second port 603 and a third port 605, six quarter wave microstrip lines 607, 609, 611, 613, 615 and 617, and three balance resistors 619, 621 and 623. Dotted lines 625, 627 and 629 in FIG. 6 are reference lines provided for analyzing the omni-directional 2-way power divider. Herein, the ports 601, 603 and 605 each have a characteristic impedance of 50Ω.

Hereinafter, an odd mode and an even mode are described for analysis of the omni-directional 2-way power divider according to the preferred embodiment of the present invention.

A. Odd Mode

Figure 7A:
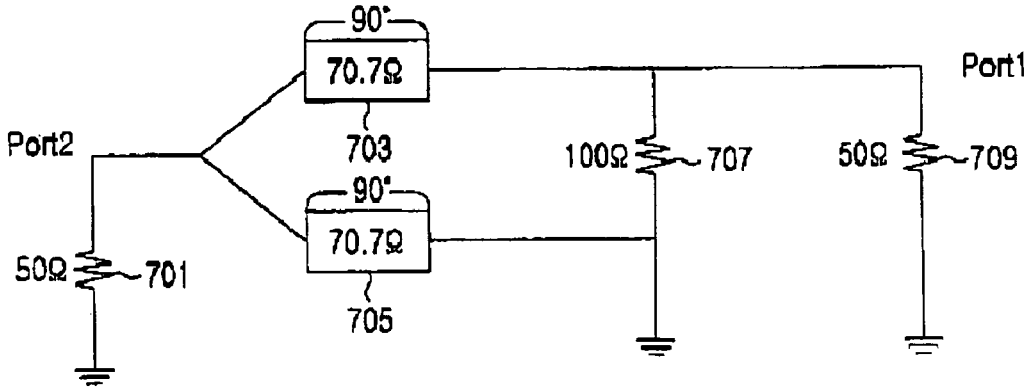
FIGS. 7*a* and 7*b* are equivalent circuit diagrams in an odd mode in an omni-directional 2-way power divider according to the first preferred embodiment of the present invention.

FIG. 7*a* is a circuit diagram showing an odd mode equivalent circuit for the ports 601 and 603 obtained by dividing the omni-directional 2-way power divider of FIG. 6 with respect to the reference line 625. Herein, in an analysis based on the odd mode, the portion in contact with the reference line 625 is short-circuited and the resistance of the balance resistor 619 cut by the reference line 625 becomes 50Ω which corresponds to ½ of the original resistance.

By the above condition, the quarter wave microstrip lines 609 and 611 of FIG. 6 represent quarter wave microstrip lines 703 and 705 of FIG. 7*a* respectively, and the balance resistors 619 and 621 of FIG. 6 represent resistors 709 and 707 of FIG. 7*a*. Further, when the characteristic of a wave microstrip line is considered, the quarter wave microstrip line 607 of FIG. 6 can be omitted due to a short of the first port 601.

In consideration of the characteristic of the odd mode, the quarter wave microstrip line 703 of FIG. 7*a* can be omitted because electric current does not flow in the quarter wave microstrip line 703. Consequently, the equivalent circuit of FIG. 7*a* can be more simply shown as FIG. 7*b*.

Figure 7B:
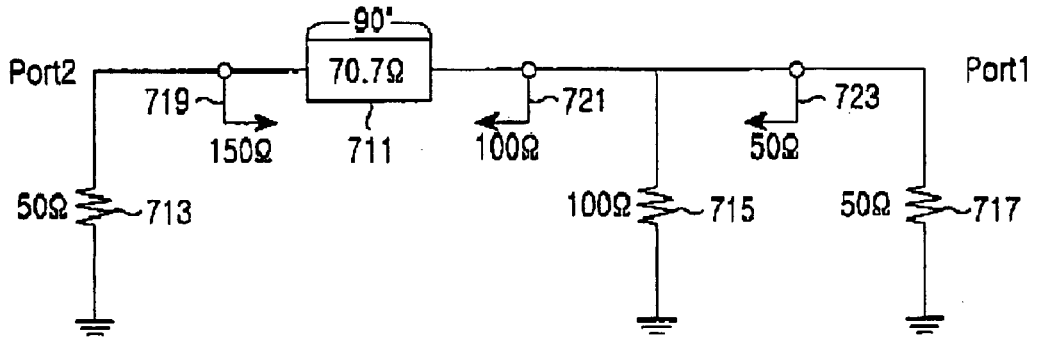

The equivalent circuit of FIG. 7*b* includes a quarter wave microstrip line 711 and three resistors 713, 715 and 717. Referring to FIG. 7*b*, impedance of a port 2 direction at a point 721 has a value of 100Ω by the quarter wave microstrip line 711 and a resistor 713 of the port 2. Further, impedance viewed at a point 723 is 50Ω because the resistance 100Ω viewed at the point 721 is connected in parallel to a resistor 715. Accordingly, it can be understood that impedance matching is accomplished.

B. Even Mode

Figure 8A:
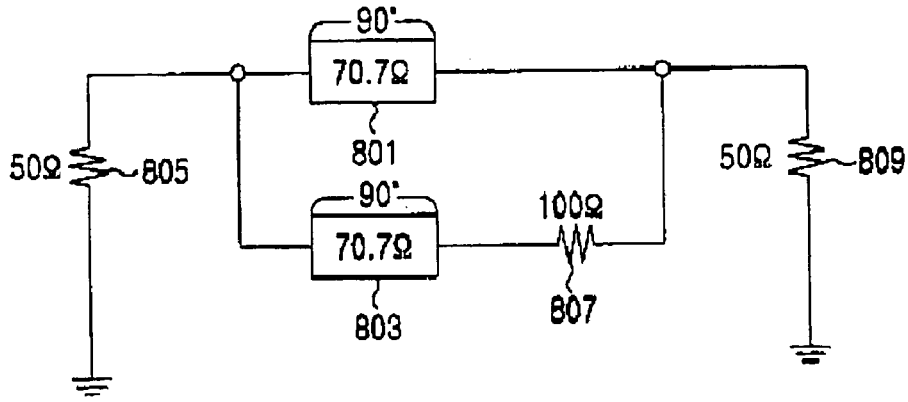
FIGS. 8*a* and 8*b* are equivalent circuit diagrams in an even mode in an omni-directional 2-way power divider according to a preferred embodiment of the present invention.

FIG. 8*a* is a circuit diagram showing an even mode equivalent circuit for the ports 601 and 603 obtained by dividing the omni-directional 2-way power divider of FIG. 6 with respect to the reference dotted line 625. Herein, in an analysis based on the even mode, a portion of FIG. 6 in contact with the reference dotted line 625 is opened. Further, the resistance of the balance resistor 619 cut by the reference dotted line 625 becomes 50Ω which corresponds to ½ of the original resistance, similar to the odd mode.

Referring to FIG. 8*a*, the even mode equivalent circuit of FIG. 8*a* includes two quarter wave microstrip lines 801 and 803 and three resistors 805, 807 and 809. In order to analyze the even mode equivalent circuit, a ABCD parameter and a Y parameter for the quarter wave microstrip line 803 and the resistor 807 of a lower portion may be expressed by the following Equations 1 and 2, respectively.

$$\begin{bmatrix} A & B \\ C & D \end{bmatrix}_L = \begin{bmatrix} 0 & j70.7 \\ \frac{j}{70.7} & 0 \end{bmatrix} \begin{bmatrix} 1 & 100 \\ 0 & 1 \end{bmatrix} = \begin{bmatrix} 0 & j70.7 \\ \frac{j}{70.7} & \frac{100}{70.7} \end{bmatrix} \quad \text{Equation 1}$$

$$\begin{bmatrix} Y_{11} & Y_{12} \\ Y_{21} & Y_{22} \end{bmatrix}_L = \begin{bmatrix} \frac{100}{70.7^2} & \frac{-1}{j70.7} \\ \frac{-1}{j70.7} & 0 \end{bmatrix} \quad \text{Equation 2}$$

Next, in FIG. 8*a*, a ABCD parameter and a Y parameter for the quarter wave microstrip line 801 of an upper portion may be expressed by the following Equations 3 and 4, respectively.

$$\begin{bmatrix} A & B \\ C & D \end{bmatrix}_U = \begin{bmatrix} 0 & j70.7 \\ \frac{j}{70.7} & 0 \end{bmatrix} \quad \text{Equation 3}$$

$$\begin{bmatrix} Y_{11} & Y_{12} \\ Y_{21} & Y_{22} \end{bmatrix}_U = \begin{bmatrix} 0 & \frac{-1}{j70.7} \\ \frac{-1}{j70.7} & 0 \end{bmatrix} \quad \text{Equation 4}$$

In FIG. 8*a*, a total Y parameter of the Y parameter for the quarter wave microstrip line 801 of the upper portion and the Y parameter for the quarter wave microstrip line 803 and the resistor 807 of the lower portion may be expressed by sum of the above Equations 2 and 4 because the quarter wave microstrip line 801 is connected in parallel to the quarter wave microstrip line 803 and the resistor 807.

$$\begin{bmatrix} Y_{11} & Y_{12} \\ Y_{21} & Y_{22} \end{bmatrix}_T = \begin{bmatrix} Y_{11} & Y_{12} \\ Y_{21} & Y_{22} \end{bmatrix}_L + \begin{bmatrix} Y_{11} & Y_{12} \\ Y_{21} & Y_{22} \end{bmatrix}_U = \begin{bmatrix} \frac{100}{70.7^2} & \frac{-2}{j70.7} \\ \frac{-2}{j70.7} & 0 \end{bmatrix} \quad \text{Equation 5}$$

-continued $$\begin{bmatrix} A & B \\ C & D \end{bmatrix}_T = \begin{bmatrix} 0 & \frac{j70.7}{2} \\ \frac{j2}{70.7} & \frac{j50}{70.7} \end{bmatrix} = \begin{bmatrix} 0 & j35.35 \\ \frac{j}{35.35} & \frac{j25}{35.35} \end{bmatrix} \quad \text{Equation 6}$$

Figure 8B:
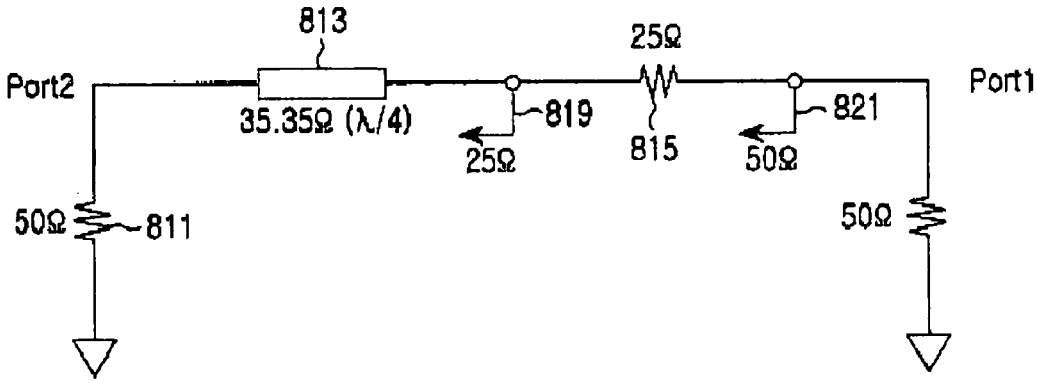

FIG. 8*b* is an equivalent circuit obtained by simplifying the equivalent circuit of FIG. 8*a* by the total ABCD parameter. Referring to FIG. 8*b*, impedance of a port 2 direction at a point 819 has a value of 25Ω by an input resistor 811 and a quarter wave microstrip line 813 of the port 2. Further, because the impedance viewed at the point 819 is connected in series to a resistor 815, impedance at a point 821 is 50Ω. Accordingly, it can be understood that impedance matching is accomplished.

It will be recognized that the aforementioned method can be similarly applied to the reference points 627 and 629 of FIG. 6, and that impedance matching is accomplished even in the second port 603 and the third port 605.

An S parameter of the omni-directional 2-way power divider of the present invention may be expressed by the following Equation 7.

$$S_{2way} = \begin{bmatrix} S_{11} & S_{12} & S_{13} \\ S_{21} & S_{22} & S_{23} \\ S_{31} & S_{32} & S_{33} \end{bmatrix} = \begin{bmatrix} 0 & \frac{-j}{\sqrt{4}} & \frac{-j}{\sqrt{4}} \\ \frac{-j}{\sqrt{4}} & 0 & \frac{-j}{\sqrt{4}} \\ \frac{-j}{\sqrt{4}} & \frac{-j}{\sqrt{4}} & 0 \end{bmatrix} \quad \text{Equation 7}$$

As shown in the above Equation 7, in the omni-directional 2-way power divider according to the present invention, since impedance matching is accomplished in the three ports, a value of $S_{11}$, $S_{22}$, $S_{33}$ becomes 0. Further, it can be understood that the other power is uniformly distributed.

Further, in the divider, matching is accomplished in each port and signal transmission between adjacent ports is possible.

Figure 9:
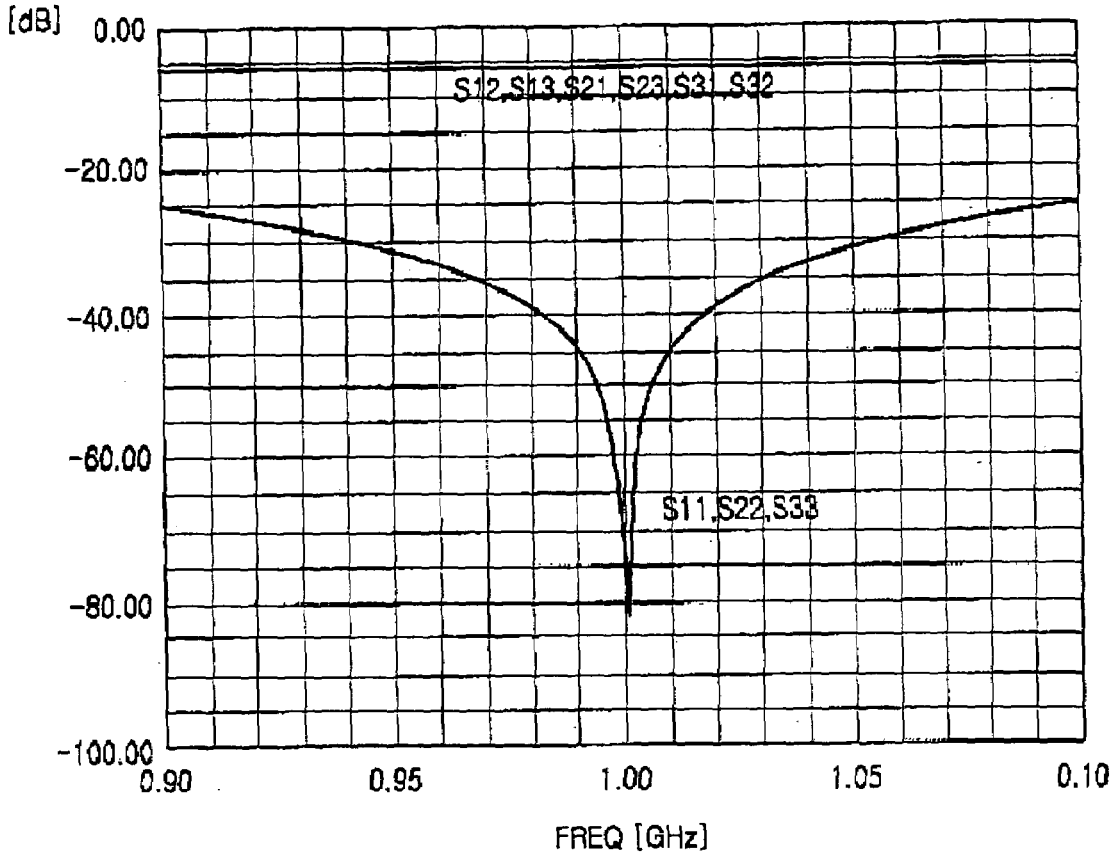
FIG. 9 is a graph illustrating a design result of an omni-directional 2-way power divider according to the preferred embodiment of the present invention.

FIG. 9 is a graph illustrating a design result of the omni-directional 2-way power divider according to the preferred embodiment of the present invention. Referring to FIG. 9, since $S_{11}$, $S_{22}$, $S_{33}$ each show a power level smaller than −80 dB at 1 GHz, it can be understood that impedance matching is accomplished in each port. Further, $S_{12}$, $S_{13}$, $S_{21}$, $S_{23}$, $S_{31}$, $S_{32}$ each show a power level of about −6 dB. Accordingly, as shown in the design result, it can be understood that the omni-directional 2-way power divider according to the present invention enables signal transmission between any ports while maintaining impedance matching in all ports.

Next, since an omni-directional 3-way power divider according to a second embodiment of the present invention is similar to the omni-directional 2-way power divider, the omni-directional 3-way power divider will be briefly described hereinafter.

Figure 10:
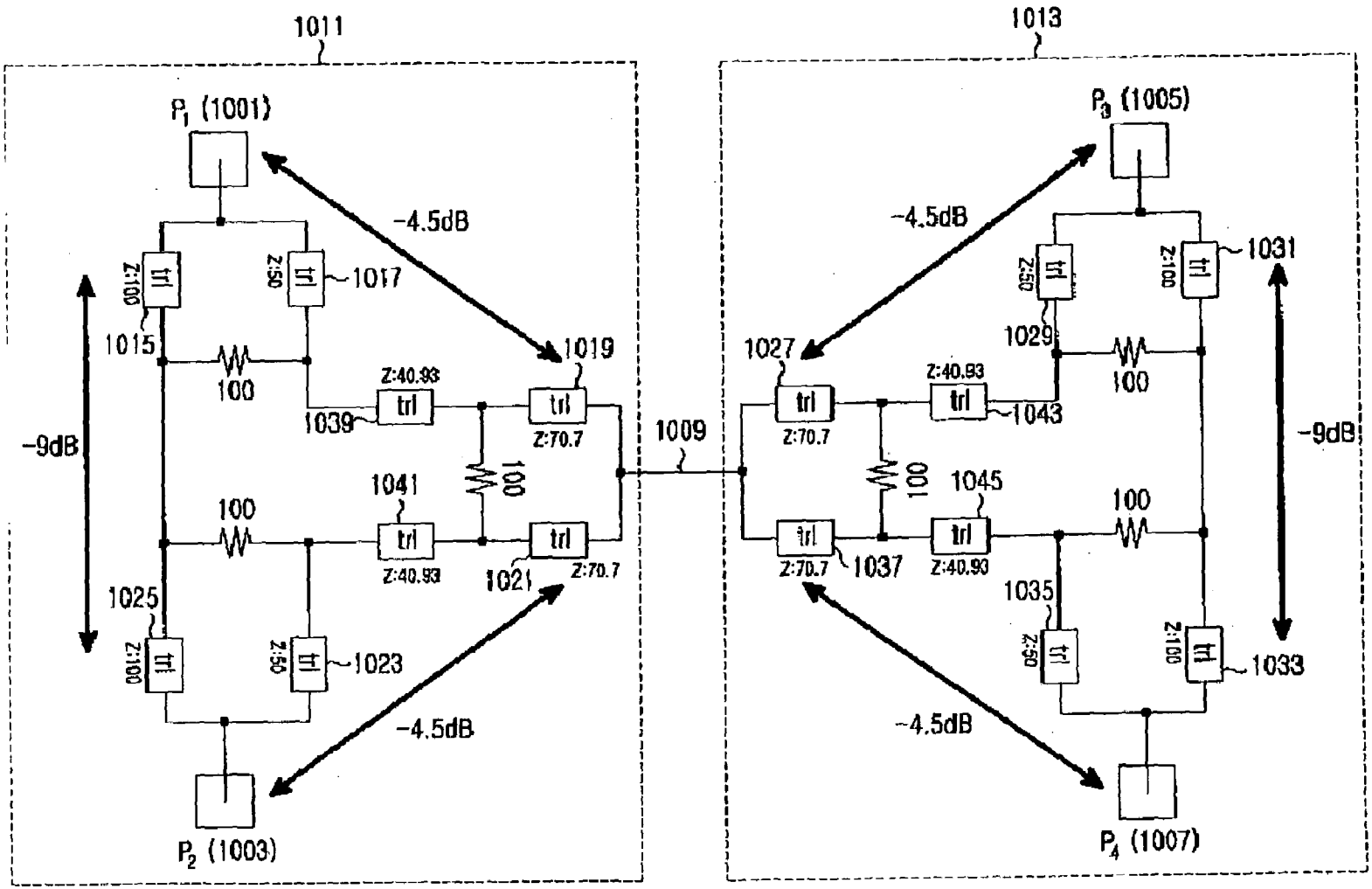
FIG. 10 is a circuit diagram showing an omni-directional 3-way power divider according to a second preferred embodiment of the present invention.

FIG. 10 is a circuit diagram showing the omni-directional 3-way power divider. Referring to FIG. 10, the omni-directional 3-way power divider is constructed by connecting two omni-directional 2-way power dividers 1011 and 1013 with each other. In the omni-directional 3-way power divider according to the present invention, power of −4.5 dB is distributed in each of the ports 1001, 1003, 1005 and 1007 and toward each of the ports in a point 1009 at which the omni-directional 2-way power dividers 1011 and 1013 are connected to each other, so that power of −9 dB is distributed in each of the ports 1001, 1003, 1005 and 1007. Accordingly, power is not uniformly distributed through each port of the omni-directional 2-way power dividers 1011 and 1013, and the modified 2-way power dividers are referred to as an irregular divider. In order to accomplish matching in the omni-directional 3-way power divider, two quarter wave microstrip lines 1039 and 1041 must be added to the omni-directional 2-way power divider 1011, two quarter wave microstrip lines 1043 and 1045 must be added to the omni-directional 2-way power divider 1013, and then the values of the quarter wave microstrip lines 1015, 1017, 1023, 1025, 1029, 1031, 1033 and 1035 must properly change, for example, as shown in FIG. 10. Herein, the S parameter of the omni-directional 3-way power divider may be expressed by the following Equation 8.

$$S_{3way} = \begin{bmatrix} S_{11} & S_{12} & S_{13} & S_{14} \\ S_{21} & S_{22} & S_{23} & S_{24} \\ S_{31} & S_{32} & S_{33} & S_{34} \\ S_{41} & S_{42} & S_{43} & S_{44} \end{bmatrix} = \begin{bmatrix} 0 & \frac{-j}{\sqrt{8}} & \frac{-j}{\sqrt{8}} & \frac{-j}{\sqrt{8}} \\ \frac{-j}{\sqrt{8}} & 0 & \frac{-j}{\sqrt{8}} & \frac{-j}{\sqrt{8}} \\ \frac{-j}{\sqrt{8}} & \frac{-j}{\sqrt{8}} & 0 & \frac{-j}{\sqrt{8}} \\ \frac{-j}{\sqrt{8}} & \frac{-j}{\sqrt{8}} & \frac{-j}{\sqrt{8}} & 0 \end{bmatrix} \quad \text{Equation 8}$$

As shown in the above Equation 8, power is uniformly distributed to all ports.

Finally, four quarter wave microstrip lines 1019, 1021, 1027 and 1037 are added to the two omni-directional 2-way power dividers, so that power can be uniformly distributed, thereby enabling an expansion to the omni-directional 3-way power divider.

While the invention has been shown and described with reference to certain preferred embodiments, it will be understood by those skilled in the art that various changes in form and details may be made therein without departing from the spirit and scope of the invention as defined by the appended claims.

What is claimed is:

1. A high frequency omni-directional 2-way power divider which includes one input terminal and two output terminals so that a signal inputted is uniformly distributed to the two output terminals, the high frequency omni-directional 2-way power divider comprising:

a first Wilkinson regular divider including one input terminal and first and second output terminals;

a second Wilkinson regular divider including one input terminal and third and fourth output terminals, the third output terminal being connected to the first output terminal of the first Wilkinson regular divider; and a third Wilkinson regular divider including one input terminal and fifth and sixth output terminals, the fifth output terminal being connected to the second output terminal of the first Wilkinson regular divider and the sixth output terminal being connected to the fourth output terminal of the second Wilkinson regular divider, wherein, when one of the three input terminals contained in the first to the third Wilkinson regular divider is used as the input terminal of the 2-way power divider, the other two input terminals function as output terminals to which power is uniformly distributed.

2. The high frequency omni-directional 2-way power divider as claimed in claim 1, wherein each Wilkinson regular divider includes two quarter wave microstrip lines and one balance resistor.

3. The high frequency omni-directional 2-way power divider as claimed in claim 2, wherein each of the two quarter wave microstrip lines has a characteristic impedance of 70.7Ω.

4. The high frequency omni-directional 2-way power divider as claimed in claim 2, wherein the balance resistor has a value of 100Ω.

5. The high frequency omni-directional 2-way power divider as claimed in claim 1, wherein each input terminal has a characteristic impedance of 50Ω.

6. A high frequency omni-directional 3-way power divider which includes one input terminal and three output terminals so that a signal inputted is uniformly distributed to the three output terminals, the high frequency omni-directional 3-way power divider comprising a first and a second high frequency omni-directional 2-way power divider, each of the first and the second high frequency omni-directional 2-way power dividers comprising:

a Wilkinson regular divider having one input terminal and first and second output terminals;

a first Wilkinson irregular divider having one input terminal and first and second output terminals, the first output terminal of the first Wilkinson irregular divider being connected to the first output terminal of the Wilkinson regular divider;

a second Wilkinson irregular divider having one input terminal and first and second output terminals, the first output terminal of the second Wilkinson irregular divider being connected to the second output terminal of the regular divider, the second output terminal of the second Wilkinson irregular divider being connected to the second output terminal of the first Wilkinson irregular divider;

a first quarter wave microstrip line connected to a point at which the first terminal of the Wilkinson regular divider is connected to the first output terminal of the first Wilkinson irregular divider; and a second quarter wave microstrip line connected to a point at which the second terminal of the Wilkinson regular divider is connected to the first output terminal of the second Wilkinson irregular divider, wherein, input terminals of the Wilkinson regular divider and of the first and the second dividers are connected with each other, and wherein, when one of the input terminals contained in the first and the second dividers is used as the input terminal of the high frequency omni-directional 3-way power divider, the other three input terminals function as output terminals to which power is uniformly distributed.

7. The high frequency omni-directional 3-way power divider as claimed in claim 6, wherein the high frequency omni-directional 3-way power divider distributes power by −9 dB from one input terminal to the remaining input terminals.

8. The high frequency omni-directional 3-way power divider as claimed in claim 6, wherein power of −4.5 dB is distributed to each of the input terminals of the Wilkinson irregular dividers at a point at which input terminals of the Wilkinson regular dividers in the first and the second high frequency 2-way divider are connected with each other.

9. A high frequency omni-directional 2-way power divider which includes one input terminal and two output terminals so that a signal inputted is uniformly distributed to the two output terminals, the high frequency omni-directional 2-way power divider comprising:

a first divider including one input terminal and first and second output terminals;

a second divider including one input terminal and third and fourth output terminals, the third output terminal being connected to the first output terminal of the first divider; and a third divider including one input terminal and fifth and sixth output terminals, the fifth output terminal being connected to the second output terminal of the first divider and the sixth output terminal being connected to the fourth output terminal of the second divider, wherein, when one of the three input terminals contained in the first to the third divider is used as the input terminal of the 2-way power divider, the other two input terminals function as output terminals to which power is uniformly distributed.

10. The high frequency omni-directional 2-way power divider as claimed in claim 9, wherein each divider includes two quarter wave microstrip lines and one balance resistor.

11. The high frequency omni-directional 2-way power divider as claimed in claim 10, wherein each of the two quarter wave microstrip lines has a characteristic impedance of 70.7Ω.

12. The high frequency omni-directional 2-way power divider as claimed in claim 10, wherein the balance resistor has a value of 100Ω.

13. The high frequency omni-directional 2-way power divider as claimed in claim 9, wherein each input terminal has a characteristic impedance of 50Ω.

14. A high frequency omni-directional 3-way power divider which includes one input terminal and three output terminals so that a signal inputted is uniformly distributed to the three output terminals, the high frequency omni-directional 3-way power divider comprising a first and a second high frequency omni-directional 2-way power divider, each of the first and the second high frequency omni-directional 2-way power dividers comprising:

a regular divider having one input terminal and first and second output terminals;

a first irregular divider having one input terminal and first and second output terminals, the first output terminal of the first irregular divider being connected to the first output terminal of the regular divider;

a second irregular divider having one input terminal and first and second output terminals, the first output terminal of the second irregular divider being connected to the second output terminal of the regular divider, the second output terminal of the second irregular divider being connected to the second output terminal of the first irregular divider;

a first quarter wave microstrip line connected to a point at which the first terminal of the regular divider is connected to the first output terminal of the first irregular divider; and a second quarter wave microstrip line connected to a point at which the second terminal of the regular divider is connected to the first output terminal of the second irregular divider, wherein, input terminals of the regular divider and of the first and the second dividers are connected with each other, and wherein, when one of the input terminals contained in the first and the second dividers is used as the input terminal of the high frequency omni-directional 3-way power divider, the other three input terminals function as output terminals to which power is uniformly distributed.

15. The high frequency omni-directional 3-way power divider as claimed in claim 14, wherein the high frequency omni-directional 3-way power divider distributes power by −9 dB from one input terminal to the remaining input terminals.

16. The high frequency omni-directional 3-way power divider as claimed in claim 14, wherein power of −4.5 dB is distributed to each of the input terminals of the irregular dividers at a point at which input terminals of the regular dividers in the first and the second high frequency 2-way divider are connected with each other.

* * * * *